428-911 SR
7/3/79 XR 4,160,060

United States Patent [19] [11] 4,160,060
Bynum, Jr. [45] Jul. 3, 1979

[54] PLATFORM SAFETY BARRIER

[75] Inventor: Douglas Bynum, Jr., Spring, Tex.

[73] Assignee: Continental Oil Company, Ponca City, Okla.

[21] Appl. No.: 871,295

[22] Filed: Jan. 23, 1978

[51] Int. Cl.[2] ..... B32B 3/26

[52] U.S. Cl. ..... 428/310; 166/75 R; 428/71; 428/76; 428/138; 428/313; 428/492; 428/911

[58] Field of Search ..... 61/1 R, 7; 166/75 R, 166/364, 368; 428/71, 76, 137, 138, 310, 311, 313, 315, 492, 494, 911

[56] References Cited

U.S. PATENT DOCUMENTS

| | | | |
|---|---|---|---|
| 1,791,856 | 2/1931 | Van Dusen | 428/313 |
| 3,118,153 | 1/1964 | Hood | 428/310 |
| 3,813,281 | 5/1974 | Burgess et al. | 428/310 |
| 3,816,234 | 6/1974 | Winfield | 428/315 |
| 3,941,189 | 3/1976 | Peevey | 166/364 |
| 3,954,537 | 5/1976 | Alfter et al. | 428/310 |
| 4,061,815 | 12/1977 | Poole, Jr. | 428/315 |
| 4,101,704 | 7/1978 | Hiles | 428/315 |

FOREIGN PATENT DOCUMENTS

| | | | |
|---|---|---|---|
| 486427 | 6/1938 | United Kingdom | 428/315 |

*Primary Examiner*—William J. Van Balen
*Attorney, Agent, or Firm*—Cortlan R. Schupbach, Jr.

[57] ABSTRACT

A means is provided for protecting off-shore platforms from damage to interior portions by inadvertantly dropped heavy objects such as drill collars. The invention comprises a crash barrier having a penetration resistant mat overlying a foamed thermoplastic or rubber shock absorbant. The invention has several advantages over previously used wooden boards such as reduced weight for equivalent protection. The foamed thermoplastic or rubber is provided with flame resistant materials such that combustion is not supported in the event of a fire.

17 Claims, 5 Drawing Figures

PLATFORM SAFETY BARRIER

This invention relates to protecting marine offshore platforms from falling objects. This invention especially relates to protecting the drill floor by preventing falling objects such as drill collars, pipe, and the like from penetrating the drill floor and injuring people or damaging equipment in the substructure, and to protecting well heads, especially Christmas trees over producing wells, from falling objects. The term "wellhead" as used herein includes the "Christmas tree" which also includes the master valves, tees, swab valves and wing valves which sit on the casing spool and hanging equipment. The invention particularly concerns placing of a safety barrier between the wellhead and/or interior area of an offshore structure so as to protect the offshore structure interior portions or wellhead from any falling debris.

As the world supply of hydrocarbons has dwindled, more and more attention has been given to searching for liquid hydrocarbons beneath marine bodies of water, necessitating the construction of larger and larger offshore platforms. In recent years especially, there has been considerable attention directed to the drilling and production of oil and gas wells located in water. These wells are drilled in the ocean floor from either fixed platforms or from floating structures or vessels. Currently, fixed platforms are the preferred means, which requires driving long piles into the ocean floor, erecting a working area above, drilling wells, and then producing through the wells from the oil deposits. When using such fixed platforms, the drilling rig is set on the platform above the surface of the water and the wells are drilled, normally using dry land techniques with some adaptations. After the well is drilled and completed, producing equipment separators, wellheads and the like are located on the platform itself above the surface of the water.

Usually, these structures contain many wells drilled from one offshore structure. As is well-known in the industry, it is a tremendous waste of time and capital to have a structure capable of having up to 30 wells and drilling all 30 wells before production is begun. Therefore it is desirable that as soon as one well has been drilled to a reservoir, that it begin producing while other wells are concurrently drilled.

One problem with this desirable operation is the danger of damage to the wellheads by fire or by blowouts when drilling equipment is dropped on the Christmas trees at the head of producing wells. This is especially true where the Christmas trees are located on the platform itself, or are only immediately below the surface, in the area where much activity in the drilling phase of production is underway. In several instances, dropped objects have severely damaged producing wells, releasing an enormous amount of flammable hydrocarbons into the vicinity of the platform and adding to the danger of fire through sparks caused by falling metallic objects.

Fires which occur on platforms themselves will burn themselves out as soon as the fuel is exhausted unless the fire is fed by leaking wellheads. Such a state is obviously undesirable since damage to equipment and danger to personnel is enormous. In addition the fire can result in wells producing in an uncontrolled state. Such fires can continue for weeks until such time as the wells are killed by drilling directional wells for bottom hole control or are otherwise brought under control. Such well control is an enormous expense and waste of natural resources, in view of the time and expense it takes to stop the fire as well as the production lost during the fire.

At the present time there is a reluctance to include normal production equipment on platforms having producing wellheads; that is, there is a reluctance to drill and produce from the same platform. This reluctance is based on safety considerations, primarily to avoid exposing the producing wellheads to fire caused by falling objects or debris. This problem exists since drilling techniques require much overhead movement of heavy drill collars, pipe stems and other heavy objects. Since storage on a offshore platform is limited, these objects must constantly be moved over producing wellheads and personnel area. Lloyds of London and the United States Department of Energy have both consistantly rated this activity as extremely high risk. The alternative to concurrent drilling and production is the use of two platforms side by side, with added expense and time, or the cessation of production until all drilling is complete, again adding enormously to the time before production is begun, as well as lost income from the non-producing wells.

One method of preventing falling debris from penetrating to the interior of a platform is simply to build the platform of materials so thick so as to be able to totally prevent penetration by falling objects. However, it is well known that on offshore platforms, excess weight is undesirable since added weight is added cost and expense of maintenance. However, some form of protection is necessary, for example, in the North Sea, since codes and regulation require inherently safe simultaneous drilling and producing operations, which implies that inadvertant release of drill collars or other heavy objects of the like from the drilling rig not penetrate the drill floor or wellhead area of the platform. Since steel of sufficient thickness to prevent penetration is extremely heavy and very expensive, current methods of solving the problem primarily center on the use of wood timbers as a crash barrier. However, these wooden barriers are inadequate since they also add excessive weight to the structure. Wood timbers up to 18 inches in thickness are necessary. In addition, these timbers must be supported which requires additional structure and thus more weight. As yet another negative aspect of wooden timbers, they tend to fuel a fire and hold glowing embers such that fighting a fire is made more difficult.

It would therefore be of great benefit to provide a lightweight, penetration resistant barrier which would protect the drilling area, wellhead area, and other interior portions of offshore platforms.

It is therefore an object of the present invention to provide a suitable safety barrier for offshore platforms. Other objects will become apparent to those skilled in this art as the description proceeds.

The present invention provides a lightweight noncorrosive safety barrier having an extremely high capacity for shock absorbtion and high probability for precluding penetration of falling objects.

This invention concerns an offshore structure safety barrier to prevent falling objects from penetrating horizontal surfaces comprising a penetration-resistant layer overlying an impact absorbing material of sufficient thickness to absorb the anticipated impact energy. Normally, this safety barrier will be inserted in sections beneath the horizontal surface to be protected, in the structural area normally between the I-beams, and will be held in place either by bolting to the I-beams or by placing a second impact-containing layer beneath the I-beams so as to absorb the force of the blow when dissipated through the safety barrier. The safety barrier absorbs impact by deforming a rubber material or allowing a thermoplastic foam material to cave, while the penetration-resistant barrier at the upper edge of the horizontal safety barrier prevents penetration into interior spaces.

No prior art is known which describes the invention claimed herein, although the problem is well-known in the art. There is much literature in the field of offshore structures. One patent, U.S. Pat. No. 3,941,189 provides for a subsurface wellhead shield, but this provides no protection to interior spaces of platforms and is excessively heavy, cumbersome, and requires much storage area.

BRIEF DESCRIPTION OF THE DRAWINGS

The invention is more concretely described with reference to the drawings. Various modifications and objects of the drawings can be easily seen after reference to the drawings and the discriptive explanation thereof. Generally.

DETAILED DESCRIPTION OF THE DRAWINGS

Figure 1:
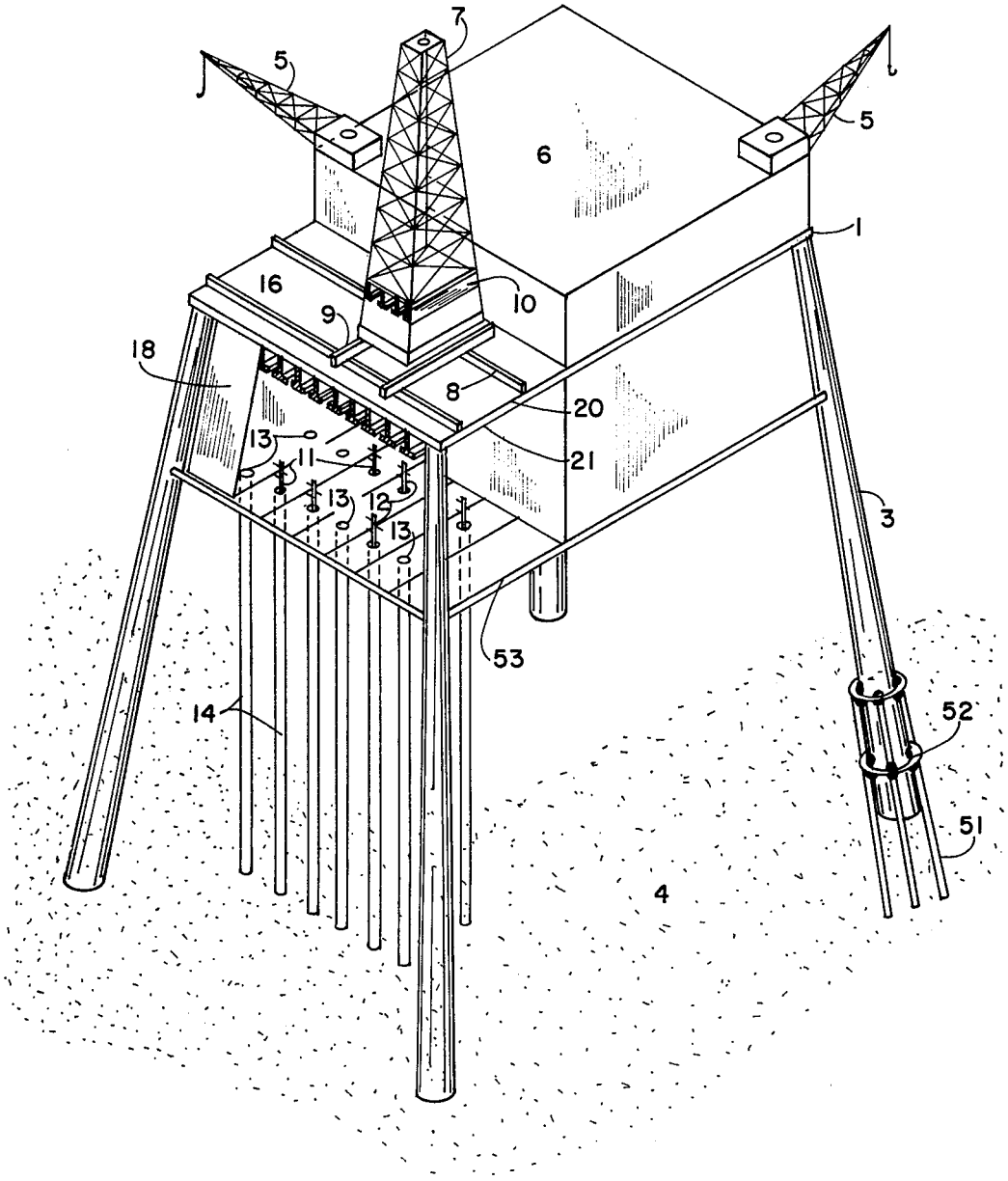
FIG. 1 is an isometric view of an offshore structure containing both drilling activity and producing wells.

FIG. 1, an isometric view of an offshore structure shows the platform itself (1) which is supported on jacket legs (3), with piles (51) driven through the legs or through skirts (52) into an ocean bed (4). The platform contains cranes (5) which are used to move heavy objects from a storage area (6) to a position where said objects can be utilized by a drilling tower (7). The drilling tower is movably supported on two sets of tracks (8) and (9) which allow positioning of the tower and the substructure (10) over any one of the multiple wellheads (11). As shown in the figures, several of the wellheads have Christmas trees (12) indicating them to be producing wells, whereas some of the wellheads (13) are undergoing drilling activity. Casing (14) is shown descending into the sea floor and thence into the oil reservoirs. Access from the drilling tower (7) to the wellheads (11) (12) and (13) is provided through the horizontal deck (16). Usually such access is through removable panels, one for each wellhead so the other wellheads are protected during drilling activity. Vertical structural panels separate wells with panels on each of the four vertical sides around the wellhead. The height of the vertical walls around each wellhead from the cellar level (53) up to the platform level (21) typically varies from 18 to 38 feet.

Figure 2:
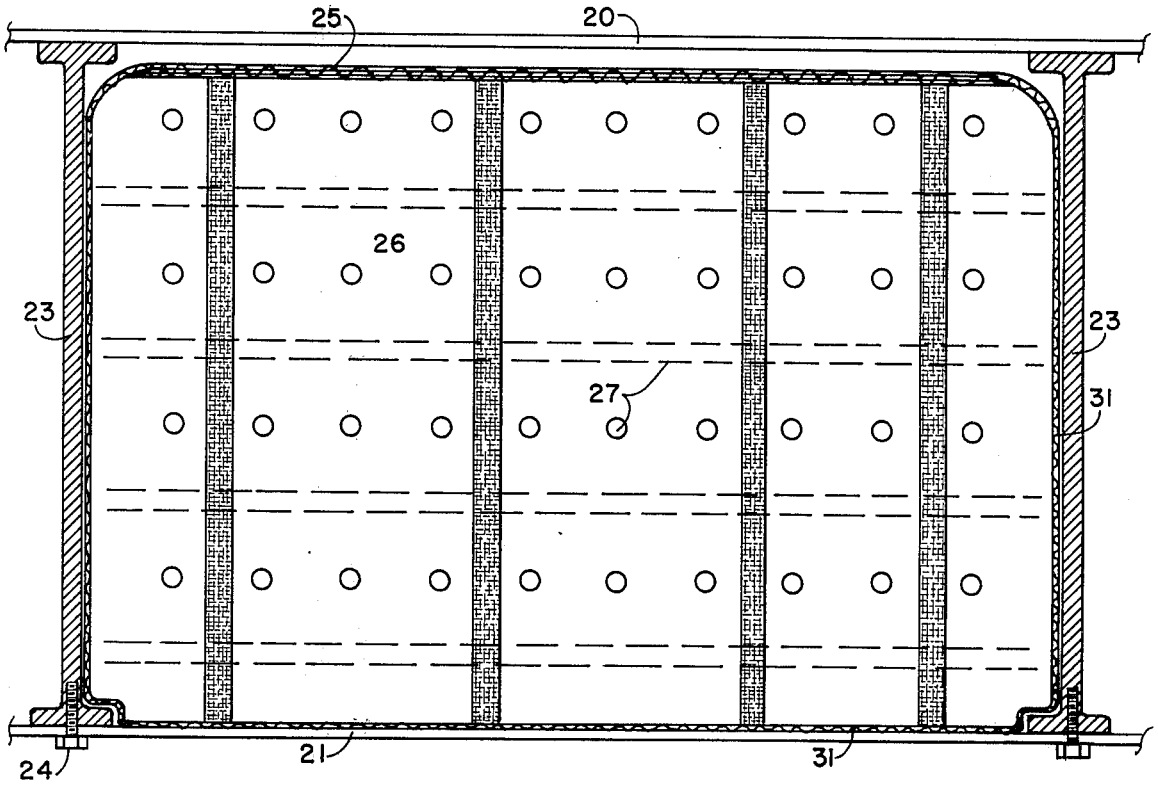
FIG. 2 is a cross-sectional view of the interior of a horizontal surface between two structural members showing the safety barrier in place.

FIG. 2 is a cross-sectional view between two I-beams (23), showing the upper deck (20) and the lower level (21) of the crash barrier. The steel plates both above (20) and below (21) the I-beam structure are held in place by any convenient means, usually such as by fastening bolts (24) or welding or any other means well-known to those skilled in this art.

The safety barrier itself can be of any convenient size sufficient to withstand anticipated impact. For example, the I-beams, when in position as shown for offshore platform use, can be any depth up to 3 or 4 feet. Thus the thickness of the barrier contained therein need only be sufficient to withstand anticipated impact and need not necessarily fill the entire space.

In the particular mode shown in FIG. 2, a penetration resistant layer (25) is placed over an impact absorbing layer (26). Apertures throughout the impact absorbing layer (27) are provided to allow for some deformation of the absorbing layer. The penetration resistant layer (25) if flexible, is optionally attached to the I-beams or if rigid, overlies the impact absorbing layer so as to spread the course of the impact over the entire layer. The entire safety barrier is supported by floor (21) which easily contains the total force exerted on it since the force is spread by the safety barrier over the entire surface of the floor (21).

Figure 3:
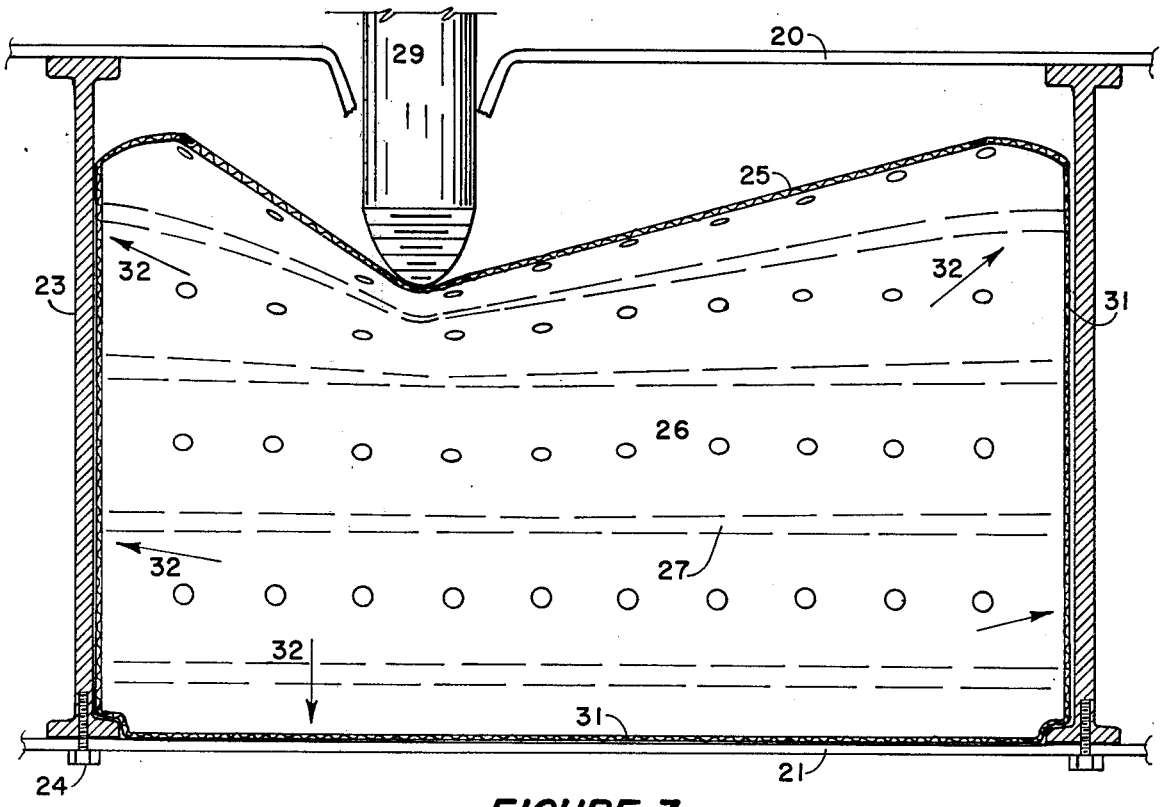
FIG. 3 illustrates the same sectional view as FIG. 2 while in operation preventing a falling object from penetrating to the interior of the structure.

FIG. 3 shows the safety barrier under maximum stress exerted by a falling heavy object (29). As the figure represents, the falling object (29) has penetrated the upper level (29) and has encountered the penetration resistant barrier (25). In the figure, the penetration resistance barrier (25) is a flexible fabric which covers the entire upper surface of the impact absorbing layer (26) and can be connected by straps (31) to effectively surround the impact absorbent material. As the object descends further into the impact absorbing material, the penetration resistant material (25) prevents the object from penetrating into the impact absorbing material (26). The deformation holes (27) are compressed at the point of impact and the force of the falling object is transmitted equally in all directions away from the point of impact as indicated by arrows (32).

Once the falling object has been stopped before penetrating the lower level (21) the object is removed, the upper deck (20) is repaired, the safety barrier returns to its original configuration if an elastomer or the penetration resistant barrier is replaced if necessary as when a thermoplastic foam is used, and the safety barrier is again ready for use.

Figure 4:
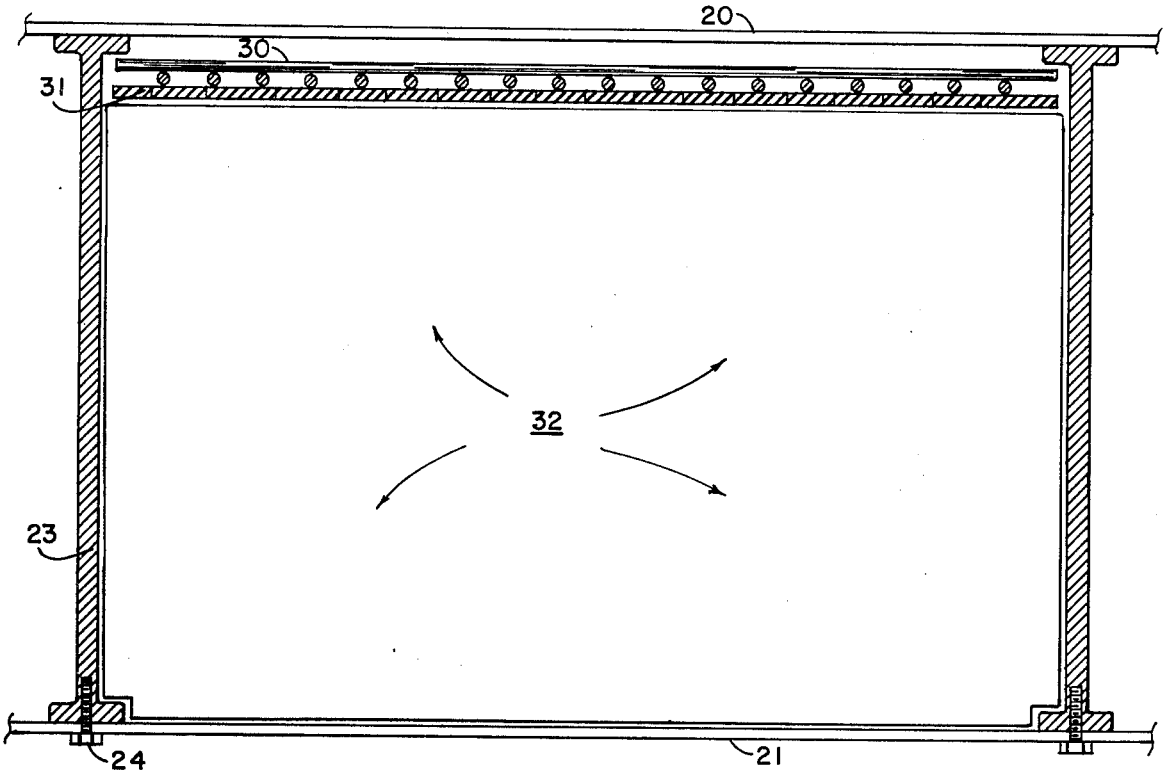
FIG. 4 illustrates the use of readily available inexpensive materials such as scrap tire sidewalls, rebar mats and foamed thermoplastic.

If a foamed thermoplastic impact absorbing layer (26) is used, or if a reinforced matting penetration resistant barrier is used (25) replacement of the entire safety barrier would be necessary, since the thermoplastic foam successively caves as the object approaches the bottom level (21) and no reuse is possible. This embodiment is shown in FIG. 4, wherein a rebar penetration resistant barrier (30) is shown overlying a fiber-reinforced rubber mat, (31) which in turn overlies a foamed thermoplastic. The fiber reinforcing the rubber mat can be either wire or non-metallic fibers. The foamed thermoplastic is light weight and requires no deformation cavities. The rubber mat reinforced with fabric can be sidewalls from scrap tires, or if desired, entire scrap tires.

Figure 5:
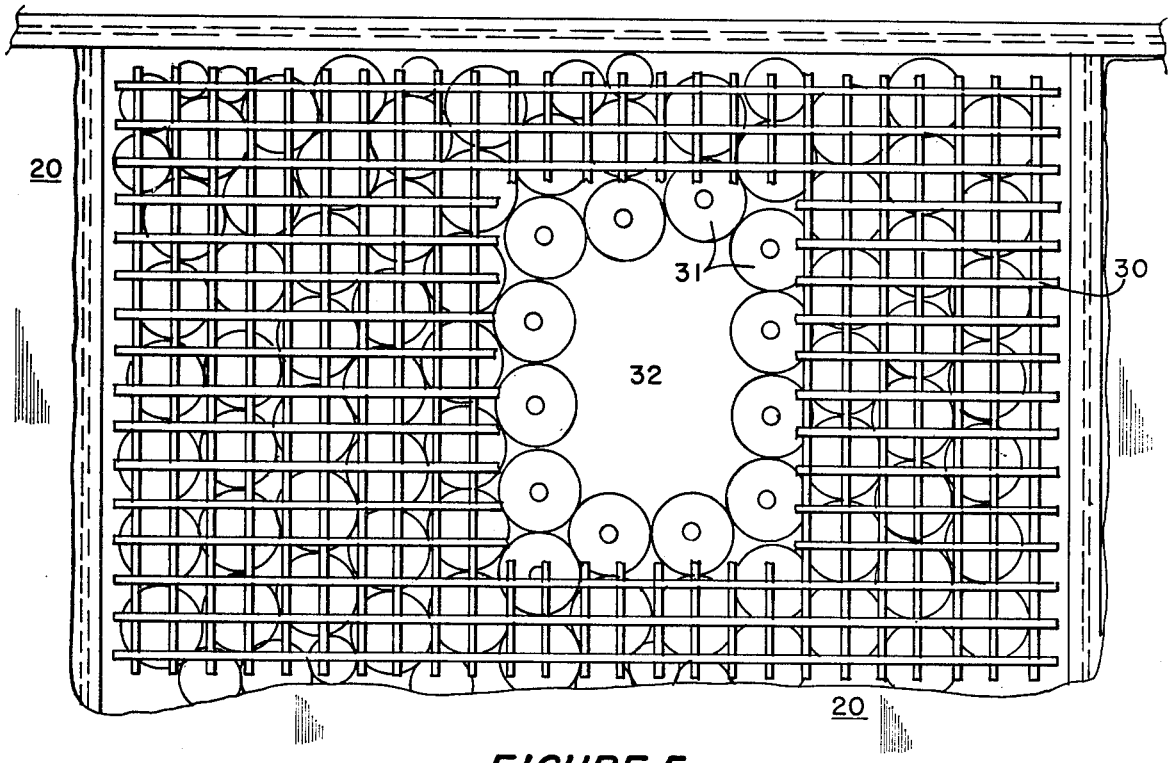
FIG. 5 is a top sectional view of FIG. 4.

FIG. 5 is a top sectional view of FIG. 4, showing placement of the fiber reinforced rubber sidewalls (31) situated so as to form additional penetration resistance, and underlying the rebar grid (30). The sidewalls can be attached to the steel grid.

A fairly broad choice of materials is available for both the penetration resistant barrier and for the impact absorbing layer. For example, the penetration resistant barrier can be a network of rebar which overlies the impact absorbing material. Since grids of steel reinforcement are so commonly used in construction with Portland concrete, the rebar is widely available and would be relatively inexpensive and its use could be immediate and easy to facilitate. However, more preferred but much more expensive than rebar would be materials specifically made for this purpose, such as a rubber mat reinforced with steel wire, or high impact fibers such as fiberglass, nylon, polyester, steel, or aramid fibers, or combinations of these. However, most preferred but again more expensive is a mat comprising several layers of penetration resistant fabric already well known for use in safety vests or flack jackets. Such a penetration resistant barrier would be comprised of several layers of aramid or nylon fiber which is extremely light in weight, yet resists penetration to a surprising extent.

Considering lowest cost, minimum weight, use of readily available materials, ease of fabrication, installation with finished prefabricated panels, the preferred embodiment of this invention is a foamed plastic shock absorbing layer overlaid with one layer of sidewall from scrap tires. All tires consist of rubber reinforced with fiber such as nylon, rayon, polyester or steel. This embodiment could be prefabricated sandwich panels with the penetration resistant layer of tire sidewalls and foamed plastic with steel plate over the tires and under the foamed plastic. Alternatively, the tire sidewalls can be tied in place, the steel plates welded in, and the plastic foamed in place in the field for use on existing installations.

The load can be made to spread over a wider area and therefore, crush more plastic by putting a grid of steel wire or rods over the scrap tire sidewalls. In either case the scrap tire layer is required since without this layer, the drill collar would penetrate the upper steel cover plate, put the load on the steel grid, and the grid would simply shear through the foamed plastic or rubber without deforming the whole cross sectional area of the shock absorbing material. FIG. 5 is a top view of FIG. 4 showing placement of scrap tire sidewalls.

Designs for the safety barrier described herein is based on the heaviest objects subject to drop, and the impact which must be absorbed. Usually the heaviest objects which are subject to dropping, with subsequent damage to the platform, are treble tiers of drill collars and casing slips. Although the size of such objects are subject to some variation, an average size for drill collars is the 9½ inch collar (3½ inch inside diameter, 7⅝ drill collar pin, 217 pounds/foot, 31 feet long/collar), while casing slips average about 14 inches and weigh approximately 5000 pounds. These objects, when falling from maximum height, would approximate the following:

Table I

| | Collar | Slip |
|---|---|---|
| Weight, Kip (1000 lbs) | 20 | 5 |
| Drop height, feet | 10 | 50 |
| Impact velocity, feet/second | 25.4 | 56.7 |
| Momentum, mass x velocity | 508 | 284 |
| Barrier depth, feet | 3 | 2 |
| Barrier crush, feet | 2 | 1 |
| Impact deacceleration, ft/sec$^2$ | 161 | 1607 |
| Dynamic force factor, numeric | 5 | 50 |
| Maximum dynamic force, Rip | 100 | 250 |
| Deacceleration work, ft.-Rip | 100 | 125 |
| Impact area, inches$^2$ | 70.8 | 1100 |
| Absorber crush (true strain) | .51 | .41 |

Table I-continued

| | Collar | Slip |
|---|---|---|
| Minimum barrier modulus, psi | 5400 | 1800 |

The impact absorbing layer can be any one of a number of readily available materials. Representative examples of such materials are natural rubber, synthetic rubber, mixtures of natural and synthetic rubber, polystyrene foam, polyurethane foam and other foamed thermoplastic materials. These materials can easily contain flame retardant materials well-known to those skilled in thermoplastic art, which would prevent these lightweight safety barriers from adding any hazard to a fire encountered on an offshore structure.

The modulus of the barrier will vary with choice of materials used, but the material chosen should be in certain ranges for maximum effect. For collars the modulus should be from about 4000 to about 7000, and for slips from about 1000 to about 2000, but depending on the absorber thickness.

When the impact absorbing material is a foamed thermoplastic, polystyrene or polyurethane foams are preferred. These foams will normally be present in a layer of from about 0.5 to about 4 feet in thickness and have a density of from about 5 to about 15 pounds per cubic foot. When foamed thermoplastic materials are used as the impact absorbing layer, no void areas are necessary as the foamed areas themselves contain sufficient voids to allow compression of the foam during absorption of the impact. These materials successively "cave" as the falling object is slowed to a stop.

When natural or synthetic rubbers, or mixtures of these are used as the impact absorbing material, it is necessary to provide void areas (27) as shown in FIGS. 2 and 3 to allow for deformation of the elastomer, since these materials are essentially incompressible. However, these materials have astoundingly high impact absorption properties. Comparing rubber to foamed plastic for the energy absorbing layer (26), foamed plastics would cost less and would weigh less than foam rubber. These materials must contain sufficient void area to allow for the deformation which would be caused by the anticipated impact. When these elastomers are used, the impact absorbing layer need not be as thick as when foamed thermoplastics are used and normally will range from about 2 inches to about 2 feet in thickness.

Thus it can be seen that a lightweight, economical, easily replaceable safety barrier is provided for offshore structures. This safety barrier is easily placed so as not to require valuable floor space and prevents falling objects from penetrating horizontal surfaces. The invention is applicable not only to drilling floors, wellhead areas, but also personnel and maintenance areas such as turbines, water and food supplies and so fourth.

While certain embodiments and details have been shown for the purpose of illustrating this invention, it will be apparent to those skilled in this art that various changes and modifications may be made herein without departing from the spirit or the scope of the invention.

I claim:

1. A safety barrier to prevent falling objects from penetrating horizontal surfaces of offshore structures and entering space below said surfaces comprising, (a) A penetration resistant layer overlying (b) an impact absorbing material of sufficient thickness to absorb anticipated impact energy, disposed (c) beneath said horizontal surface of said structure, and (d) over said space to be protected beneath said surface.

2. A safety barrier as described in claim 1 wherein the penetration resistant material is a steel mat.

3. A safety barrier as described in claim 1 wherein the penetration resistant material is a steel or fiber reinforced rubber mat.

4. A safety barrier as described in claim 1 wherein the penetration resistant material is a fabric consisting of at least 1 layer of a material selected from the group consisting of nylon or aramide or combinations of these.

5. A safety barrier as described in claim 1 wherein the impact absorbing material is selected from the group consisting of natural rubber, synthetic rubber, mixtures of natural and synthetic rubber, or foamed thermoplastic materials.

6. A safety barrier as described in claim 5 wherein the impact absorbing material is a foamed thermoplastic selected from the group consisting of polystyrene foams or polyurethane foams.

7. A material as described in claim 6 wherein the foam is from about 0.5 to about 4 feet in thickness.

8. A safety barrier as described in claim 7 wherein the foam density is from about 3 to about 15 pounds per cubic foot.

9. A safety barrier as described in claim 5 wherein rubber is natural rubber, synthetic rubber or mixtures of these, said rubber containing sufficient void areas to allow for deformation caused by impact absorbtion.

10. A safety barrier as described in claim 9 wherein the rubber is in a layer from about 2 inches to about 2 feet in thickness.

11. A safety barrier as described in claim 5 wherein the impact absorbing materials contain sufficient flame-retardant additives to render the material non-supportive to combustion.

12. A safety barrier as described in claim 1 wherein the barrier is prefabricated for attachment to structural frame members.

13. A safety barrier as described in claim 6 wherein a steel-reinforced rubber mat is interposed between the penetration resistant material and the foamed thermoplastic.

14. A safety barrier as described in claim 7 wherein the offshore platform simultaneously supports both drilling and production activity.

15. A safety barrier as described in claim 1 where the impact absorbing material is foamed plastic and the overlying penetration resistant layer is a fiber reinforced rubber sheet.

16. A safety barrier as described in claim 15 where the overlying penetration resistant layer is one layer of one side of scrap tires consisting of tire sidewalls.

17. A safety barrier as described in claim 16 where a grid of steel wire or rod is placed over the scrap tires to maximize plastic deformation.

* * * * *

UNITED STATES PATENT AND TRADEMARK OFFICE

CERTIFICATE OF CORRECTION

PATENT NO. : 4,160,060

DATED : July 3, 1979

INVENTOR(S) : Douglas Bynum, Jr.

It is certified that error appears in the above-identified patent and that said Letters Patent are hereby corrected as shown below:

Column 5, line 51, "7 1/8" should be --7 5/8--.

Column 8, line 17, "7" should be --1--.

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*